United States Patent [19]

Chiang

[11] Patent Number: 4,758,317

[45] Date of Patent: Jul. 19, 1988

[54] PROCESS AND CELL FOR PRODUCING HYDROGEN PEROXIDE

[75] Inventor: John S. C. Chiang, Mercerville, N.J.

[73] Assignee: FMC Corporation, Philadelphia, Pa.

[21] Appl. No.: 932,834

[22] Filed: Nov. 20, 1986

[51] Int. Cl.[4] ..... C25B 1/30; C25B 9/00; C25B 11/03; C25B 13/04

[52] U.S. Cl. ..... 204/84; 204/265; 204/266; 204/284; 204/283; 204/296; 204/294

[58] Field of Search ..... 204/252–258, 204/263–266, 294, 284, 84, 283, 282

[56] References Cited

U.S. PATENT DOCUMENTS

| | | | |
|---|---|---|---|
| 3,454,477 | 7/1969 | Grangaard | 204/84 |
| 3,459,652 | 8/1969 | Grangaard | 204/294 |
| 3,462,351 | 8/1969 | Grangaard | 204/83 |
| 3,506,560 | 4/1970 | Grangaard | 204/263 |
| 3,507,769 | 4/1970 | Grangaard | 204/265 |
| 3,591,470 | 7/1971 | Grangaard | 204/84 |
| 3,592,749 | 7/1971 | Grangaard | 204/84 |
| 3,616,442 | 10/1971 | Cheng et al. | 204/257 |
| 3,684,670 | 8/1972 | Raetzsch | 204/258 X |
| 3,856,640 | 12/1974 | Halfar et al. | 204/84 |
| 3,893,897 | 7/1975 | Raetzsch et al. | 204/258 X |
| 4,067,787 | 1/1978 | Kastening et al. | 204/84 |
| 4,118,305 | 10/1978 | Oloman et al. | 204/265 |
| 4,224,129 | 9/1980 | McIntyre et al. | 204/263 |
| 4,244,793 | 1/1981 | Johnson et al. | 204/263 |
| 4,312,720 | 1/1982 | Lefevre | 204/78 |
| 4,317,704 | 3/1982 | McIntyre et al. | 204/1 R |
| 4,350,575 | 9/1982 | Porta et al. | 204/84 |
| 4,357,217 | 11/1982 | Kuehn et al. | 204/84 |
| 4,384,931 | 5/1983 | Jasinski et al. | 204/84 |
| 4,406,114 | 4/1984 | Dhar et al. | 204/147 |
| 4,406,758 | 9/1983 | McIntyre et al. | 204/98 |
| 4,416,758 | 11/1983 | Tseung et al. | 204/258 |
| 4,436,608 | 3/1984 | Bennett et al. | 204/265 |
| 4,455,203 | 6/1984 | Stucki | 204/84 |
| 4,488,951 | 12/1984 | Nolan et al. | 204/129 |
| 4,511,441 | 4/1985 | McIntyre et al. | 204/98 |
| 4,533,443 | 8/1985 | Wrighton et al. | 204/84 |
| 4,572,774 | 2/1986 | Wrighton et al. | 204/238 |

FOREIGN PATENT DOCUMENTS

| | | |
|---|---|---|
| 0066663 | 12/1982 | European Pat. Off. . |
| 2493878 | 5/1982 | France . |

OTHER PUBLICATIONS

Oloman et al., "Hydrogen Peroxide Production in Trickle Bed Electrochemical Reactors", *J. of App. Electrochem.* 9, 117–123.

Yeager, E., *Electrochemistry in Industry,* Plenum Press, N.Y. (1980), pp. 38–47.

Balej et al., "Electrochemical Reactors," *Fortsch Verfarenstech,* 22(D), pp. 361–389, (1984).

Kuhn, A. T., Industrial Electrochemical Process, Elsevir, N.Y. (1971), pp. 575–579.

*Primary Examiner*—Donald R. Valentine

*Attorney, Agent, or Firm*—Richard E. Elden; Robert L. Andersen; Eugene G. Seems

[57] ABSTRACT

The invention is an electrochemical cell which is useful to reduce oxygen to hydrogen peroxide at a cathode and a process employing the cell. The cell not only avoids the safety hazard of a hydrogen explosion of the prior art cells but also avoids the need for a rigid separating means and cathode.

20 Claims, 2 Drawing Sheets

PROCESS AND CELL FOR PRODUCING HYDROGEN PEROXIDE

The present invention is an electrochemical cell and a process suitable for safely reducing oxygen to hydrogen peroxide at a cathode in the presence of an alkaline electrolyte.

For over a hundred years its has been known that oxygen can be reduced at a cathode to form hydrogen peroxide. In spite of the very low voltage for the half-cell reaction the process has never been commercialized.

U.S. Pat. Nos. 4,406,758 and 4,511,411 teach a method for operating an electrochemical cell employing a gas cathode. The electrolyte is introduced into the cell in the anode compartment where a gas such as oxygen or chlorine is formed. The electrolyte then passes through a separating means into a "bed" or self-draining cathode. Oxygen gas is also introduced into the cathode and is reduced to form hydrogen peroxide. The hydrogen peroxide can optionally be decomposed or collected and employed as a bleach solution.

Both of these patents teach that the desired electrolytic reaction with gas will take place only where there is a three phase contact between a gas, an electrolyte solution and a solid electrical conductor. The patents teach that it is necessary to balance the hydraulic pressure of the electrolyte on the anode side of the separating means and on the cathode side of the separating means to maintain a controlled flow of electrolyte into the cathode and to maintain oxygen gas throughout the cathode. Pores of a sufficient size and number are provided in the cathode to allow both gas and liquid to flow simultaneously through the cathode.

The presence of oxygen is required at an oxygen cathode not only to maintain a high efficiency, but also to avoid a disastrous explosion. In the presence of an alkali metal hydroxide the oxygen cathode overall reaction is the reaction of oxygen and water to form hydroxyl ions and perhydroxyl ions (anions of hydrogen peroxide, a very weak acid). The cathode reaction is $$2O_2+2H_2O+4e^-\rightarrow 2HO_2^-+2OH^- \quad (1)$$

and the anode reaction is $$4OH^-\rightarrow O_2+2H_2O+4e^- \quad (2)$$

with an overall reaction of $$O_2+2OH^-\rightarrow 2HO_2^- \quad (3).$$

In the absence of oxygen at the cathode that half cell reaction is $$2H_2O+4e^-\rightarrow H_2+2OH^- \quad (4).$$

Undesirable side reactions can also take place at the cathode $$HO_2^-+H_2O+2e^-\rightarrow 3OH^- \quad (5)$$

and at the anode $$HO_2^-+OH^-\rightarrow O_2+H_2O+2e^- \quad (6)$$

Consequently, it is important to avoid local high concentration of the perhydroxyl ion ($HO_2^-$) from accumulating in the catholyte.

Equation (4) can predominate if the cathode does not contain oxygen gas or hydrogen peroxide (equation 5) either because the cell is flooded with electrolyte, or because the supply of oxygen is inadequate. In the absence of oxygen at the cathode hydrogen gas will be formed. The hydrogen gas may form an explosive mixture with oxygen gas in the oxygen supply manifold. In the alternative, if insufficient oxygen were introduced into the cathode, hydrogen would be formed in the oxygen-depleted section which would mix with oxygen in the oxygen-rich zone to form an explosive mixture.

In U.S. Pat. Nos. 3,454,477; 3,459,652; 3,462,351; 3,506,560; 3,507,769; 3,591,470, and 3,592,749 to Grangaard the cathode is a porous plate with the electrolyte and oxygen delivered from opposite sides for reaction on the cathode. The porous gas diffusion electrode requires a wax coating to fix the reaction zone and careful balancing of oxygen and electrolyte pressure to keep the reaction zone on the surface of the porous plate.

The electrolytic cells of U.S. Pat. Nos. 4,406,758 and 4,511,441 have a problem in that vertical dimension of the cell cannot be varied over a large range because of the need to balance the hydraulic pressure differences across the separating means and the need to avoid flooding the cathode with electrolyte, an uncontrolled flow of liquid through the separator is considered to be undesirable.

U.S. Pat. No. 4,118,305 to Oloman attempts to overcome the problems of balancing the hydrostatic forces to maintain a three-phase system of a solid electrode (cathode), a liquid electrolyte and oxygen gas by continuously flowing a mixture of oxygen gas and a liquid electrolyte through a fluid permeable cathode, such as, a porous bed of graphite particles. A porous separator separates the packed bed electrode from the adjoining electrode and is supported by the packed bed electrode. The pores of the separator are sufficiently large to allow a controlled flow of electrolyte into the openings of the packed bed electrode. Electrochemical reactions occur within the electrode at a gas-electrolyte-electrode interface. The liquid products and unreacted electrolyte flow by gravity to the bottom of the packed bed electrode. Mass transfer is a problem in such cells because the electrode is almost flooded with electrolyte. Reactions are slow and recycle of product is necessary for acceptable product strength, and recycle of the excess oxygen gas is essential for economic operation and a superatmospheric oxygen pressure is generally required.

Each of these prior art electrolytic cells have a disadvantage of requiring a voltage substantially greater than the sum of the theoretical half cell voltages because of the high ohmic resistance of the cells. A further drawback to these cells is that they lack the means to vary the capacity of the cell during operation and the difficulty in establishing uniform electrolyte flow rates in the cell.

The properties of an ideal separating means are well known to those skilled in the art. It should be cheap, of some mechanical strength and rigidity, resistant to cell reactants, products and operating conditions. Also, the ideal separating means is described as permeable to ions but not molecules, of high void fraction to minimize electrical resistance, of small means pore size to prevent the passage of gas bubbles and minimize diffusion, homogeneous to ensure good current efficiency and even current distribution, and nonconducting to prevent action as an electrode.

The present invention overcomes the deficiencies of the prior cells. The invention is an electrolytic cell for reducing oxygen to hydrogen peroxide at a cathode in the presence of an aqueous, alkaline electrolyte. The invention comprises a cell having an electrolyte inlet, an electrolyte outlet, a porous cathode impermeable to the electrolyte but permeable to a gas, the cathode having a first surface contacting the electrolyte and a second surface forming an exterior surface of the cell in contact with an oxygen-containing gas, an anode, separating means between the cathode and the anode, and means to urge the electrolyte from the electrolyte inlet to the electrolyte outlet. The separating means defines an anode compartment and a cathode compartment in the cell, the separating means being substantially permeable both to an ion in the electrolyte and to a gas, but being substantially impermeable to the flow of the electrolyte from the cathode compartment to the anode compartment. The cell is disposed with the cathode and anode in a generally horizontal attitude with the cathode superior to the anode, the anode compartment is provided with means to direct oxygen gas generated at the anode to the separating means and to urge electrolyte to flow across the surface of the anode, and the cathode compartment being provided with means to urge the electrolyte from the electrolyte inlet across the first surface of the cathode. The process of employing the cell to manufacture hydrogen peroxide is considered to be within the scope of the invention.

Desirably, the means to urge the electrolyte from the electrolyte inlet to the electrolyte outlet is the static head resulting from the elevation of the electrolyte outlet being lower than the electrolyte inlet. However, said means can include a pump or any other fluid moving means. The means to direct the oxygen gas to the separating means and to urge the electrolyte to flow uniformly across the anode may be combined, and can be any gas permeable porous material such as a felt, a woven fabric or an interconnecting foam material. Other suitable means include flow vanes in the anode compartment which direct the oxygen bubbles to the separating means, and which divert the electrolyte over the surface of the anode. A gas permeable porous means is particularly desirable because of its wicking action which aids in urging electrolyte from the electrolyte inlet to the electrolyte outlet.

The means to urge the electrolyte to flow uniformly across the surface of the cathode can be similar to the means in the anode compartment. In both cases the means may be provided by very close spacing of the cathode and the separating means so that the capillary effect of the first surface of the cathode and adjacent surface of the separating means on the electrolyte approaches the effect of gravity.

For the purpose of the present invention, the expression "substantially permeable both to an ion in the electrolyte and to a gas, but being substantially impermeable to the flow of the electrolyte from the cathode compartment to the anode compartment," shall be understood to mean that under normal operating conditions bubbles of oxygen gas generated at the anode can pass freely through the separating means from the anode compartment to the cathode compartment, but that very little electrolyte is transferred from the cathode compartment to the anode compartment.

One commercially-available separating means suitable for the present invention is a hydrophillic laminate of polyester felt and an expanded polytetrafluoroethylene consisting of nodes and interconnecting fibrils marketed by W. L. Gore and Associates. The separating means is rated in a standard ASTM test F778 as 3.8 $m^3/S$ at 125 Pa. The polyester felt portion of the laminate is suitable both as a means to direct oxygen gas from the anode to the separating means and to urge the anolyte to flow uniformly across the anode, or as the means to direct the electrolyte to flow uniformly across the cathode.

Another suitable separating means is a microporous polypropylene film $2.5\times10^{-2}$ mm thick having 38% porosity with an effective pore size of 0.02 micrometer which is marketed by Celanese Corporation. The pores provide the desired electrical conductivity but impede the flow of electrolyte. The film was perforated with openings without removing any material. The openings act as check valves and are spaced approximately every centimeter in a row and column matrix. The openings, for example, 0.5 mm to 1 mm slits, act as small bunsen valves which open to permit the flow of oxygen gas from the anode compartment into the cathode compartment and which close to exclude the flow of electrolyte from the cathode compartment to the anode compartment.

An ion conductive membrane, similarly punctured, is also suitable for use as a separating means. A typical commercial membrane is marketed by RIA Research Corporation under the trade name of Raipore BDM-10 membrane. It comprises a grafted low density polyethylene base film having a weak base cationic monomer as the graft.

It is clear that the separating means employed in the present invention differ from the well recognized "ideal separating means" in that it not only has a small mean pore size making it permeable to ions and not molecules, but also has openings of sufficient size to permit the passage of gas bubbles (gas openings) without permitting substantial diffusion or back mixing of hydrogen peroxide from the cathode compartment to the anode compartment. The optimum size, shape and distribution of the gas openings can be determined without undue experimentation. The shape of the openings may be straight slits, crosses, vees, or mere point punctures. The openings are formed, desirably, by puncturing the separating means, without removing any material from the separating means. The separating means is usually installed so that the oxygen bubbles pass through in the direction the punctures were formed. In this way the oxygen gas bubbles function as a part of the "valve".

For the purposes of this invention, the term "generally horizontal" can include angles of up to about 45°. The rate of flow of electrolyte through the cell can be varied during operation by increasing of decreasing the angle of the cell from horizontal and by varying the hydrostadic pressure difference at the cell inlet or outlet. The generally horizontal attitude of the cell provides an advantage of the present cell over all prior cells in that it is not necessary to provide a support for any part of the cell or to make any part of the cell of a rigid material. This permits employing a very thin separating means and permits very close spacing of adjacent elements of the cell. As a result, the ohmic resistance of the cell can be reduced far below that of prior cells.

The invention is described in detail with reference to figures illustrating several embodiments.

Figure 1:
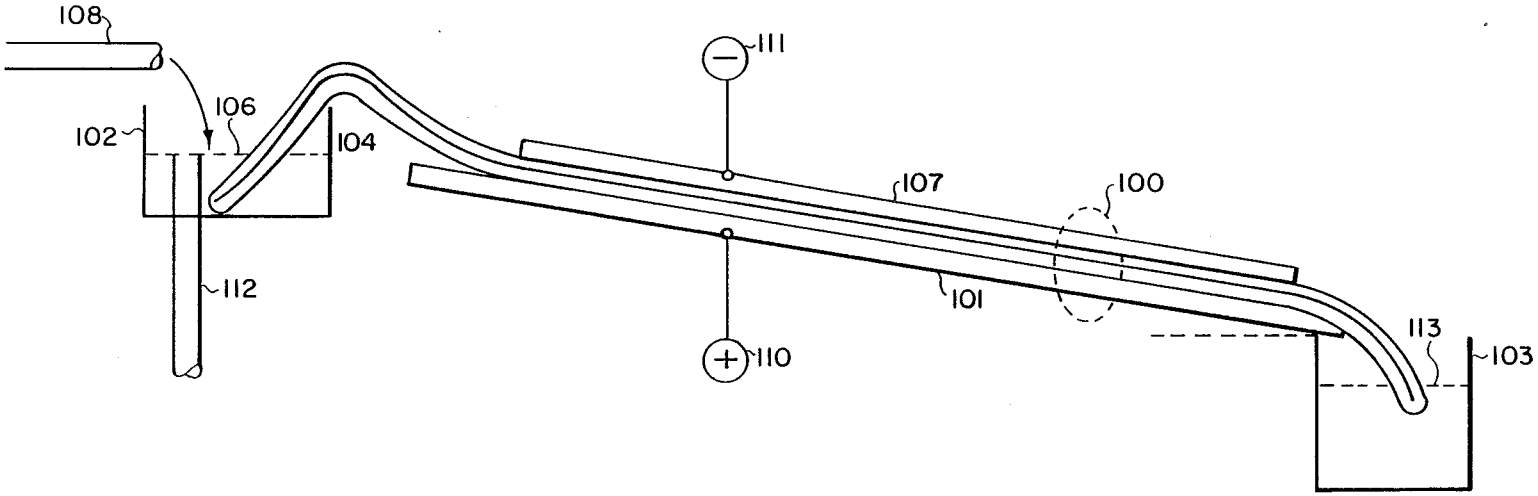
FIG. 1 is a cross-section of a cell employing a commercial PTFE felt fabric bonded to an air breathable microporous polyfluoroethylene membrane.

FIG. 1. Anode 101, a nickel or stainless steel plate, is disposed in a generally horizontal attitude between electrolyte reservoir 102 containing electrolyte 106 and electrolyte surge tank 103. A sheet of a polyester felt fabric 105 bonded to a microporous PTFE membrane 104 is supported on anode 101 with a first end in reservoir 102 forming an electrolyte inlet and the second end in surge tank 103 to form an electrolyte outlet. Electrolyte is urged to flow into and through polyester felt 105 into surge tank 103 by the static head between the level of electrolyte 106 in reservoir 102 and electrolyte 113 in surge tank 103. Reservoir 102 contains sufficient electrolyte 106 so that the upper surface of electrolyte 106 is higher than electrolyte 113 or the second end of polyester felt 105. A porous, electroconductive cathode 107 is disposed to provide a first surface superior to or above and closely adjacent to polyester felt 105 and the second surface of the cathode forms an exterior surface of cell 100 which consists of anode 101, the portion of polyester felt 105 adjacent to the cathode, PTFE membrane 104 and catode 107. The PTFE membrane 104 defining the space between the anode 101 and cathode 107 into an anode compartment, the liquid film between the anode 101 and separating means 104 (not shown) and a cathode compartment occupied by polyester felt 105. Conduit means 108 provides electrolyte to electrolyte reservoir 102 from a source (not shown). Optionally, conduit means 109 provides additional electrolyte for the cathode compartment. Conductors 110 and 111 provide a voltage to anode 101 and cathode 107 respectively from a source (not shown).

In operation electrolyte from reservoir 102 is drawn by the wicking effect of polyester felt 105 into the cathode compartment of cell 100. Sufficient electrolyte wets the lower surface of PTFE membrane 104 prior to its contact with anode 101 to supply electrolyte to the anode compartment. In the presence of electrical energy oxygen gas is formed in the anode compartment. The oxygen is directed to separating means 104 and into the cathode compartment to cathode 107 where it is reduced to hydrogen peroxide. Additional oxygen diffuses from the oxygencontaining gas at the second surface of cathode 107 to the first surface where it is also reduced to hydrogen peroxide. The electrolyte in the anode compartment and the cathode compartment may either be urged from the electrolyte inlet to the electrolyte outlet by the wicking effect of the polyester felt 105 or by static head between the level of electrolyte in reservoir 102 and the electrolyte surge tank 103.

Figure 2:
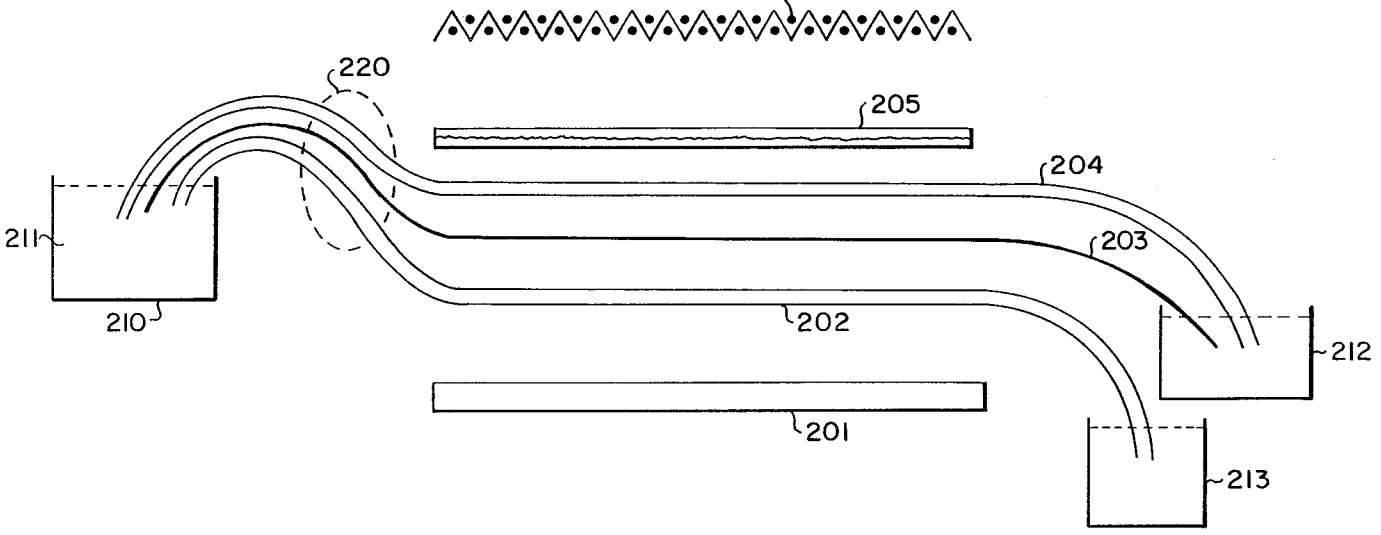
FIG. 2 is an exploded view showing an alternative embodiment to the cell 100 of FIG. 1.

FIG. 2 is an exploded view of the elements of a preferred embodiment of a cell. The elements, normally in contact with each other, comprise a nickel or stainless steel anode 201 forming the bottom of the cell surmounted sequentially by a first porous means 202, separating means 203, a second porous means 204, and porous cathode, 205 forming the upper surface of the cell exposed to a gas containing oxygen. Nickel screen 206 and anode 201 are connected to a negative and positive source of voltage (not shown).

In operation electrolyte 211 enters the cell from electrolyte reservoir 210 through the extension of porous means 202 and 204 which extensions form electrolyte inlet 220. Porous means 202 and 204 each act as a wick and distribute the electrolyte uniformly over the surface of cathode 205 and anode 201. Anode 201 and nickel screen 206 are connected to a source of electricity (not shown). At anode 201, oxygen gas is formed which rises through anode compartment porous means 202 and is directed to the lower surface of separating means 203.

Bubbles of oxygen gas pass through gas openings of separating means 203 into the cathode compartment porous means 204 and contact cathode 205. Additional oxygen gas also diffuses through cathode 205 to the surface of the electrolyte in cathode compartment porous means 204. There oxygen from both sources is reduced to form a solution of hydrogen peroxide in the electrolyte in the cathode compartment porous means 204. The electrolyte is urged from electrolyte inlet 220 across the surface of cathode 205 and anode 201 by the difference of static head of the surface of electrolyte 211 in electrolyte reservoir 210 and the lower levels of anolyte surge tank 212 and catholyte surge tank 213. The electrolyte flows from catholyte porous means 204 and anolyte porous means 202 into electrolyte surge tanks 212 and 213 respectively.

It is not necessary for the inlet or the outlet end of porous means 202 and 204 to be immersed in electrolyte as illustrated in the figures. For example, a funnel can be employed to collect electrolyte from porous means 202 and 204 at the cell outlet. Similarly at the cell inlet electrolyte can be applied directly to the porous means.

The porous means 202 and 204 may include any inert porous means, preferably felted inert fibers, woven inert fibers, knit inert fibers or an inert material having interconnected pores. The inert porous means may comprise polyester, wool, glass foam or fiber, mineral wood, asbestos, polyvinylidene, and the like.

The best mode of practicing the present invention is exemplified by the following nonlimiting examples:

EXAMPLES 1 TO 4

A cell was set up in the configuration of FIG. 1 without optional conduit means 109. The cathode was a 24 cm×15 cm×0.6 cm foam reticulated vitreous carbon (RVC) used for fuel cell electrodes having a pore volume of 97%. Oxygen gas contacted the second surface of the cathode at atmospheric pressure. A 38 cm×17 cm×1.3 mm Gortex brand fabric which provided the separating means and porous means rested on a 27 cm×19 cm 316 ss plate. The combination of wicking action of the felt and the static head urged 4% NaOH electrolyte through the cell. The static head is indicated by the tilt of the cell from horizontal. The results are compared in Table I. The cell was operated for 6 hours.

EXAMPLE 1

The cathode was commercial untreated RVC employed in U.S. Pat. No. 4,430,176 and the electrolyte contained no stabilizer.

EXAMPLE 2

Example 1 was repeated except anode was nickel and the RVC was impregnated carbon black bonded to the RVC with colloidal polytetrafluoroethylene (PTFE) to make it hydrophobic. The electrolyte was 4% NaOH containing 0.05% disodium ethylenediaminetetraacetic acid (EDTA) as a stabilizer.

EXAMPLE 3

Example 2 was repeated except the cathode was carbon black supported on a porous graphite cloth. The cloth was impregnated with colloidal PTFE and carbon black applied to the second surface.

EXAMPLE 4

Example 3 was repeated using the carbon black—a graphite felt cathode of Example 3.

The above examples have a relatively poor current efficiency. The electrolyte was provided to the anode compartment by seepage of electrolyte from the catholyte compartment prior to contact with the anode. In the cell oxygen bubbles acted as part of the valve to prevent the electrolyte in the cathode compartment from diffusing into the anode compartment. However, the examples are useful in showing that a separating means can be effective even if it permits electrolyte to transfer from the anode compartment to the cathode compartment.

EXAMPLES 5 to 7

The cell from Examples 1 to 4 was set up in a manner similar to FIG. 2 except the electrolytes from both the anode compartment and the cathode compartment were collected in a single electrolyte surge tank. The cell employed a 51 cm×15 cm cathode. A 0.025 mm thick water-wettable microporous polypropylene film was employed as a separating means having 38% porosity with an effective pore size of 0.02 μmeter. Slits were punctured through the film approximately 0.7 mm in length in a 1 cm×1 cm matrix. The first porous means for the anode compartment was a 64 cm×17 cm polyester felt 0.1 mm thick, while the second porous means for the cathode compartment was a 64 cm×17 cm polyester felt about 1 mm thick. Unless specified otherwise, the electrolyte in the reservoir was 4% NaOH containing 0.05% EDTA. The cells were operated for 5 hours with oxygen gas at atmospheric pressure in contact with the second surface of the cathode. The results are presented as Table II.

EXAMPLE 5

The cathode was carbon black deposited on 1.25 mm thick graphite cloth impregnated with PTFE and a mixture of carbon black and PTFE.

EXAMPLE 6

Example 6 was similar to Example 5 except air was employed as the gas containing oxygen instead of pure oxygen.

EXAMPLE 7

Example 5 was repeated using a cationic membrane perforated with slits as above and employed air as the gas containing oxygen. The carbon dioxide was removed from the air by contacting it with sodium hydroxide.

In comparing Examples 1 to 4 and 5 to 7, it is clear that Examples 5 to 7 are superior in terms of current efficiency and hydrogen peroxide concentration, although Examples 1 to 4 are operative examples. The superiority of Examples 5 to 7 appears to be that the bunsen valve slits punctured through the separating means were more effective than the air valves of the expanded PTFE which relied on gas bubbles for their operation.

TABLE I

| Example | °Tilt Angle | % Effic. | % $H_2O_2$ Conc. | Flow g/m | Voltage | Current Dens. A/cm$^2$ |
|---|---|---|---|---|---|---|
| 1 | 4.5 | 37.5 | 0.4 | 3.7 | 2.0 | 0.01 |
| 2 | 10.0 | 48.3 | 0.9 | 4.6 | 1.2 | 0.02 |
| 3 | 10.0 | 49.9 | 1.01 | 4.1 | 1.1 | 0.02 |
| 4 | 10.0 | 50.0 | 0.9 | 4.6 | 1.2 | 0.02 |

TABLE II

| Example | °Tilt Angle | % Effic. | % $H_2O_2$ Conc. | Flow g/m | Voltage | Current Dens. A/cm$^2$ |
|---|---|---|---|---|---|---|
| 5 | 10 | 94.0 | 1.65 | 9.31 | 1.3 | 0.02 |
| 6 | 10 | 89.0 | 1.45 | 10.06 | 1.25 | 0.02 |
| 7 | 12 | 88.1 | 1.25 | 11.52 | 1.17 | 0.02 |

What is claimed is:

1. An electrolytic cell for reducing oxygen to hydrogen peroxide at a cathode in the presence of an aqueous, alkaline electrolyte comprising a cell having an electrolyte inlet, an electrolyte outlet, a porous cathode impermeable to the electrolyte but permeable to a gas, the cathode having a first surface contacting the electrolyte and a second surface forming an exterior surface of the cell in contact with an oxygen-containing gas, an anode, separating means between the cathode and the anode defining an anode compartment and a cathode compartment in the cell, and means to urge the electrolyte from the electrolyte inlet to the electrolyte outlet, the separating means being substantially permeable both to an ion in the electrolyte and to bubbles of oxygen gas generated at the anode, but being substantially impermeable to the flow of the electrolyte from the cathode compartment to the anode compartment, the cathode and anode of said cell disposed in a generally horizontal attitude with the cathode superior to the anode, the anode compartment being provided with means to distribute bubbles of oxygen gas generated at the anode to the separating means and to urge electrolyte to flow across the surface of the anode, and the cathode compartment being provided with means to urge the electrolyte from the electrolyte inlet across the first surface of the cathode.

2. The cell of claim 1 wherein the separating means is a microporous film punctured with openings to permit the flow of oxygen gas from the anode compartment into the cathode compartment.

3. The cell of claim 1 wherein the separating means is an ion conductive membrane punctured with openings to permit the flow of oxygen gas from the anode compartment into the cathode compartment.

4. The cell of claim 1 wherein the elevation of the electrolyte outlet is lower than the elevation of the electrolyte inlet to provide a static head as the means to urge the electrolyte from the electrolyte inlet to the electrolyte outlet.

5. An electrolytic cell for reducing oxygen to hydrogen peroxide at a cathode in the presence of an aqueous, alkaline electrolyte comprising a cell having an electrolyte inlet, an electrolyte outlet, a porous cathode impermeable to the electrolyte but permeable to a gas, the cathode having a first surface contacting the electrolyte and a second surface forming an exterior surface of the cell in contact with an oxygen-containing gas, separating means, an anode, and means to urge the electrolyte from the electrolyte inlet to the electrolyte outlet, the separating means defining an anode compartment and a cathode compartment in the cell, the separating means being substantially permeable both to an ion in the electrolyte and to bubbles of oxygen gas generated at the anode, but being substantially impermeable to the flow of the electrolyte from the cathode compartment to the anode compartment, the cathode and anode of said cell disposed in a generally horizontal attitude with the cathode superior to the anode, the anode compartment being provided with a first porous means to distribute bubbles of oxygen gas generated at the anode to the separating means and to urge electrolyte to flow across the surface of the anode, and the cathode compartment being provided with a second porous means to urge the electrolyte from the electrolyte inlet across the first surface of the cathode.

6. The cell of claim 5 wherein the first porous means is a felt of inert fibers.

7. The cell of claim 5 wherein the first porous means is a woven fabric of inert fibers.

8. The cell of claim 5 wherein the first porous means is a knit fabric of inert fibers.

9. The cell of claim 5 wherein the first porous means is an inert material having interconnected pores.

10. The cell of claim 5 wherein the second porous means is a felt of inert fibers.

11. The cell of claim 5 wherein the second porous means is a woven fabric of inert fibers.

12. The cell of claim 5 wherein the second porous means is a knit fabric of inert fibers.

13. The cell of claim 5 wherein the second porous means is an inert material having interconnected pores.

14. The cell of claim 5 wherein the separating means is an inert, microporous membrane punctured with gas openings.

15. The cell of claim 5 wherein the separating means is an ion permeable punctured with gas openings.

16. The cell of claim 5 wherein the elevation of the electrolyte outlet is lower than the elevation of the electrolyte inlet to provide a static head as the means to urge the electrolyte from the electrolyte inlet to the electrolyte outlet.

17. An electrolytic cell for reducing oxygen in air to hydrogen peroxide at a cathode in the presence of an aqueous, alkaline electrolyte comprising a cell having an electrolyte inlet, an electrolyte outlet, a porous carbon cathode impermeable to the electrolyte but permeable to air, the cathode having a first surface contacting the electrolyte and a second surface forming an exterior surface of the cell in contact with air, separating means, an anode, the electrolyte outlet being at a lower elevation than the electrolyte inlet the separating means defining an anode compartment and a cathode compartment in the cell, the separating means being substantially permeable both to an ion in the electrolyte and to an oxygen gas, but being substantially impermeable to the flow of the electrolyte from the cathode compartment to the anode compartment, the anode and cathode of said cell disposed in a generally horizontal attitude less than 45° with the cathode superior to the anode, the anode compartment being provided with inert first porous means selected from the group consisting of felted inert fibers, inert fibers, knit, woven inert fibers and an inert material having interconnecting pores to distribute oxygen gas generated at the anode to the separating means and to urge electrolyte to flow across the anode, and the cathode compartment being provided with inert second porous means selected from the group consisting of felted inert fibers, inert fibers, knit, woven inert fibers and an inert material having interconnecting pores to urge the electrolyte from the electrolyte inlet across the cathode.

18. The electrolytic cell of claim 17 wherein the separating means is a microporous membrane with gas openings therein.

19. The electrolytic cell of claim 17 wherein the separating means is a cation permeable membrane with gas openings therein.

20. A process for reducing oxygen to hydrogen peroxide in an aqueous, alkaline electrolyte at a cathode of an electrolytic cell comprising introducing the electrolyte into an electrolyte having a separating means permeable to an ion in the electrolyte and a gas and impermeable to the electrolyte, said separating means defining a lower anode compartment containing an anode and an upper cathode compartment containing a generally horizontal porous carbon cathode impermeable to the electrolyte and substantially permeable to bubbles of oxygen gas generated at the anode, said cathode having a first surface contacting electrolyte and a second surface forming an exterior surface of the cell in contact with an oxygen-containing gas, urging electrolyte in anode compartment to flow across the surface of the anode to form oxygen gas, urging bubbles of oxygen gas to the separating means and into the cathode compartment, urging electrolyte in the cathode compartment across the surface of the cathode, reducing oxygen at the cathode to hydrogen peroxide and withdrawing electrolyte from the cell.

* * * * *

UNITED STATES PATENT AND TRADEMARK OFFICE

CERTIFICATE OF CORRECTION

PATENT NO. : 4,758,317

DATED : July 19, 1988

INVENTOR(S) : John S. C. Chiang

It is certified that error appears in the above-identified patent and that said Letters Patent is hereby corrected as shown below:

Column 1, line 19, "bed" should read --trickle bed--. Column 4, line 58, "increasing of decreasing" should read --increasing or decreasing--. Column 5, line 28, "catode" should read --cathode--. Column 5, line 49, "oxygencontaining" should read --oxygen-containing--. Claim 15, line 2, "permeable punctured" should read --permeable membrane punctured--.

Signed and Sealed this

Eighth Day of November, 1988

*Attest:*

DONALD J. QUIGG

*Attesting Officer*

*Commissioner of Patents and Trademarks*